US011421396B2

(12) United States Patent
Wu et al.

(10) Patent No.: US 11,421,396 B2
(45) Date of Patent: Aug. 23, 2022

(54) SHOVEL

(71) Applicant: SUMITOMO HEAVY INDUSTRIES, LTD., Tokyo (JP)

(72) Inventors: Chunnan Wu, Kanagawa (JP); Yusuke Sano, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 241 days.

(21) Appl. No.: 16/727,222

(22) Filed: Dec. 26, 2019

(65) Prior Publication Data

US 2020/0131731 A1 Apr. 30, 2020

Related U.S. Application Data

(63) Continuation of application No. PCT/JP2018/025409, filed on Jul. 4, 2018.

(30) Foreign Application Priority Data

Jul. 5, 2017 (JP) ..... JP2017-132030

(51) Int. Cl.

| | |
|---|---|
| ***E02F 3/43*** | (2006.01) |
| ***E02F 3/32*** | (2006.01) |
| ***E02F 9/20*** | (2006.01) |
| ***E02F 9/26*** | (2006.01) |

(52) U.S. Cl.

CPC ..... *E02F 3/439* (2013.01); *E02F 3/32* (2013.01); *E02F 9/2041* (2013.01); *E02F 9/26* (2013.01)

(58) Field of Classification Search

CPC ..... E02F 3/439; E02F 3/32; E02F 3/43; E02F 3/435; E02F 9/2041; E02F 9/26; E02F 9/262; E02F 9/2025

See application file for complete search history.

(56) References Cited

U.S. PATENT DOCUMENTS

| | | | | |
|---|---|---|---|---|
| 1,237,878 A * | 8/1917 | Downie | ..... | E02F 3/50 414/597 |
| 4,271,614 A * | 6/1981 | Albrecht | ..... | E02F 3/30 37/446 |
| 4,888,890 A * | 12/1989 | Studebaker | ..... | E02F 3/437 37/348 |
| 5,854,988 A * | 12/1998 | Davidson | ..... | E02F 9/26 701/50 |

(Continued)

FOREIGN PATENT DOCUMENTS

| | | |
|---|---|---|
| JP | H06-060692 U | 8/1994 |
| JP | H06-063247 | 8/1994 |

(Continued)

OTHER PUBLICATIONS

International Search Report for PCT/JP2018/025409 dated Sep. 25, 2018.

*Primary Examiner* — Russell Frejd

(74) *Attorney, Agent, or Firm* — IPUSA, PLLC

(57) ABSTRACT

A shovel includes a traveling lower body; a revolving upper body mounted on the traveling lower body; an attachment attached to the revolving upper body; and a control device mounted on the revolving upper body and configured to drive the attachment. The control device controls an angle of a teeth end of a bucket with respect to a target excavation ground, in accordance with hardness of the target excavation ground.

15 Claims, 12 Drawing Sheets

(56) References Cited

U.S. PATENT DOCUMENTS

| | | | | |
|---|---|---|---|---|
| 6,052,926 | A * | 4/2000 | Stephens | E02F 3/404 37/444 |
| 8,914,199 | B2 * | 12/2014 | Nomura | E02F 9/261 701/50 |
| 9,540,794 | B2 * | 1/2017 | Iwamura | E02F 9/2025 |
| 10,125,475 | B2 * | 11/2018 | Kenkel | E02F 9/268 |
| 2005/0178030 | A1 * | 8/2005 | Doucette | E02F 3/3681 37/443 |
| 2008/0097675 | A1 * | 4/2008 | Konishi | B60T 13/741 701/75 |
| 2009/0159302 | A1 | 6/2009 | Koch et al. | |
| 2013/0006484 | A1 * | 1/2013 | Avitzur | G05D 1/0274 701/50 |
| 2016/0258129 | A1 * | 9/2016 | Wei | E02F 9/2029 |
| 2017/0101761 | A1 | 4/2017 | Wu | |
| 2018/0230671 | A1 | 8/2018 | Wu | |

FOREIGN PATENT DOCUMENTS

| | | |
|---|---|---|
| JP | 2003-105795 | 4/2003 |
| JP | 2011-252338 | 12/2011 |
| JP | 2012-249615 | 12/2012 |
| JP | 2013-252514 | 12/2013 |
| WO | 2015/194601 | 12/2015 |
| WO | 2017/047695 | 3/2017 |

* cited by examiner

SHOVEL

CROSS-REFERENCE TO RELATED APPLICATION

The present application is a continuation application of International Application No. PCT/JP2018/025409 filed on Jul. 4, 2018, which is based on and claims priority to Japanese Patent Application No. 2017-132030 filed on Jul. 5, 2017. The contents of these applications are incorporated herein by reference in their entirety.

BACKGROUND

Technical Field

The present disclosure relates to a shovel provided with an excavation attachment.

Description of Related Art

A shovel provided with an excavation attachment that is constituted with a boom, an arm, and a bucket has been known.

This shovel calculates excavation reaction force acting on the end of the bucket from the attitude of the excavation attachment. Then, the boom is automatically raised when the excavation reaction force exceeds a predetermined value. This is because by making the excavation depth shallower, wasteful excavation operations such that the bucket would become immobile can be avoided.

However, the shovel described above calculates the excavation reaction force without taking the hardness of the target excavation ground into account. Therefore, if the target excavation ground is hard, the excavation reaction force is calculated to be smaller than actually is, and the boom cannot be raised at the right timing. As a result, the shovel performs wasteful excavation operations, which may cause the bucket to become immobile. On the other hand, if the target excavation ground is soft, the excavation reaction force is calculated to be greater than actually is, and the boom may be raised too early. As a result, the amount of earth and sand entering the bucket in a single excavation operation is decreased, which lowers the work efficiency.

In view of the above, it is desirable to provide a shovel that enables more efficient excavation.

SUMMARY

A shovel according to an embodiment in the present disclosure includes a traveling lower body; a revolving upper body mounted on the traveling lower body; an attachment attached to the revolving upper body; and a control device mounted on the revolving upper body and configured to drive the attachment. The control device controls an angle of a teeth end of a bucket with respect to a target excavation ground, in accordance with hardness of the target excavation ground.

DETAILED DESCRIPTION

Figure 1:
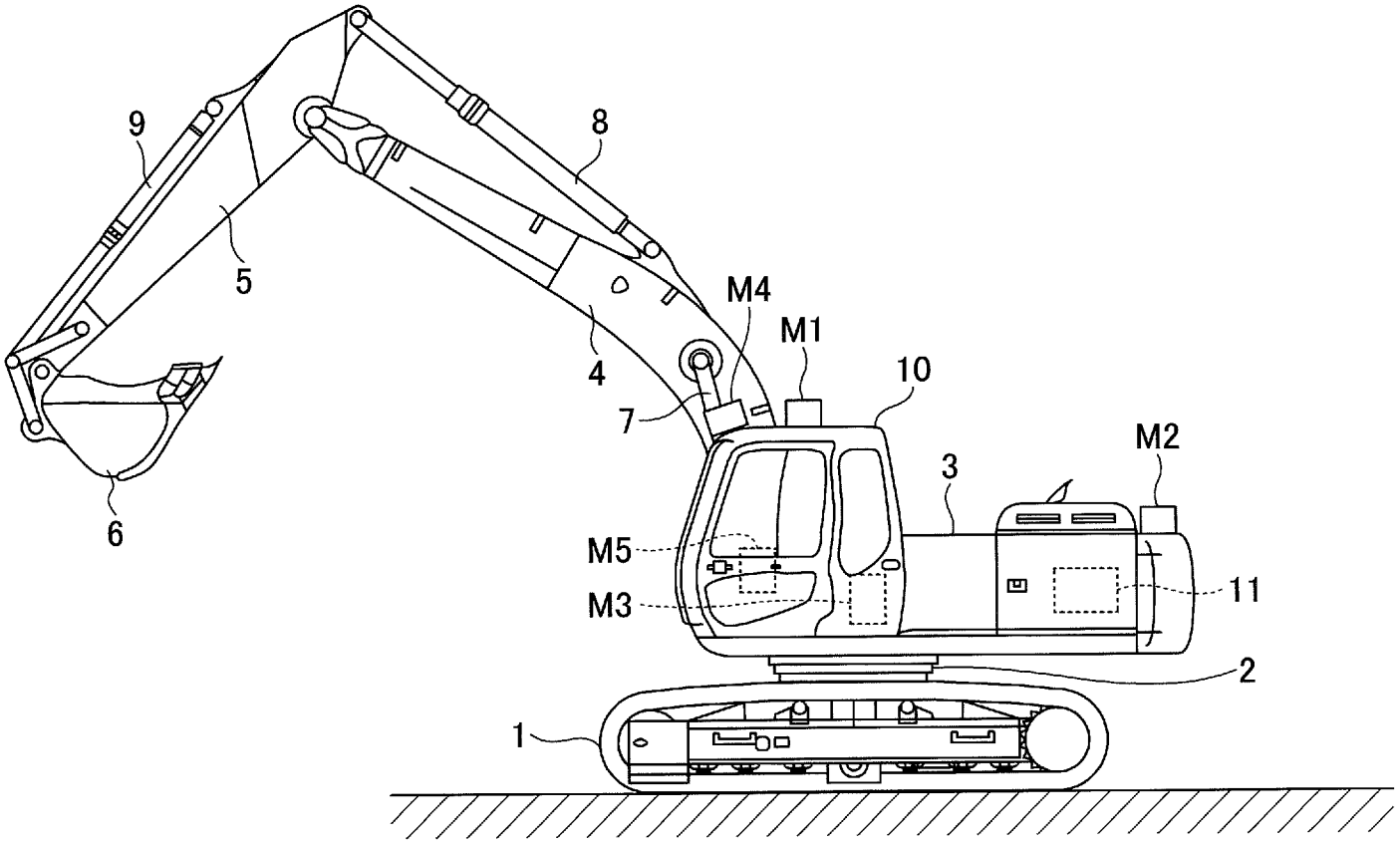
FIG. 1 is a side view of a shovel according to an embodiment in the present disclosure.

In the following, embodiments will be described. According to an embodiment, it is possible to provide a shovel that enables more efficient excavation. First, with reference to FIG. 1, a shovel (excavator) as a construction machine will be described according to an embodiment in the present disclosure. Note that FIG. 1 is a side view of the shovel according to the embodiment in the present disclosure. On a traveling lower body 1 of the shovel illustrated in FIG. 1, a revolving upper body 3 is mounted via a revolution mechanism 2. A boom 4 is attached to the revolving upper body 3. An arm 5 is attached to the end of the boom 4, and a bucket 6 is attached to the end of the arm 5. The boom 4, arm 5, and bucket 6 as working elements constitute an excavation attachment, which is an example of an attachment. The boom 4 is driven by a boom cylinder 7. The arm 5 is driven by an arm cylinder 8. The bucket 6 is driven by a bucket cylinder 9. The revolving upper body 3 is provided with a cabin 10, and has a power source such as an engine 11 mounted. The revolving upper body 3 also has a communication device M1, a positioning device M2, an attitude detector M3, an imaging device M4, and a cylinder pressure detector M5 attached.

The communication device M1 is configured to control communication between the shovel and the outside. In the present embodiment, the communication device M1 controls radio communication between a survey system based on the GNSS (Global Navigation Satellite System) and the shovel. Specifically, the communication device M1 obtains landform information of a worksite when starting a shovel operation, for example, once a day. The GNSS-based survey system adopts, for example, a network-type RTK-GNSS positioning system.

The positioning device M2 is configured to measure the position of the shovel. In the present embodiment, the positioning device M2 is a GNSS receiver having an electronic compass built in, which measures the latitude, longitude, and altitude of the current position of the shovel, and measures the direction of the shovel.

The attitude detector M3 is configured to detect the attitude of the attachment. In the present embodiment, the attitude detector M3 detects the attitude of the excavation attachment.

The imaging device M4 is configured to obtain an image around the shovel. In the present embodiment, the imaging device M4 includes a forward camera attached to the revolving upper body 3. The forward camera is a stereo camera to capture images in front of the shovel, which is attached to the roof of the cabin 10, namely, outside the cabin 10. The forward camera may be attached to the ceiling of the cabin 10, namely, inside the cabin 10. The forward camera can capture images of the excavation attachment. The forward camera may be a monocular camera.

The cylinder pressure detector M5 is configured to detect the pressure of hydraulic operating fluid in a hydraulic cylinder. In the present embodiment, the cylinder pressure detector M5 detects the pressure of the hydraulic operating fluid in each of the boom cylinder 7, the arm cylinder 8, and the bucket cylinder 9.

Figure 2:
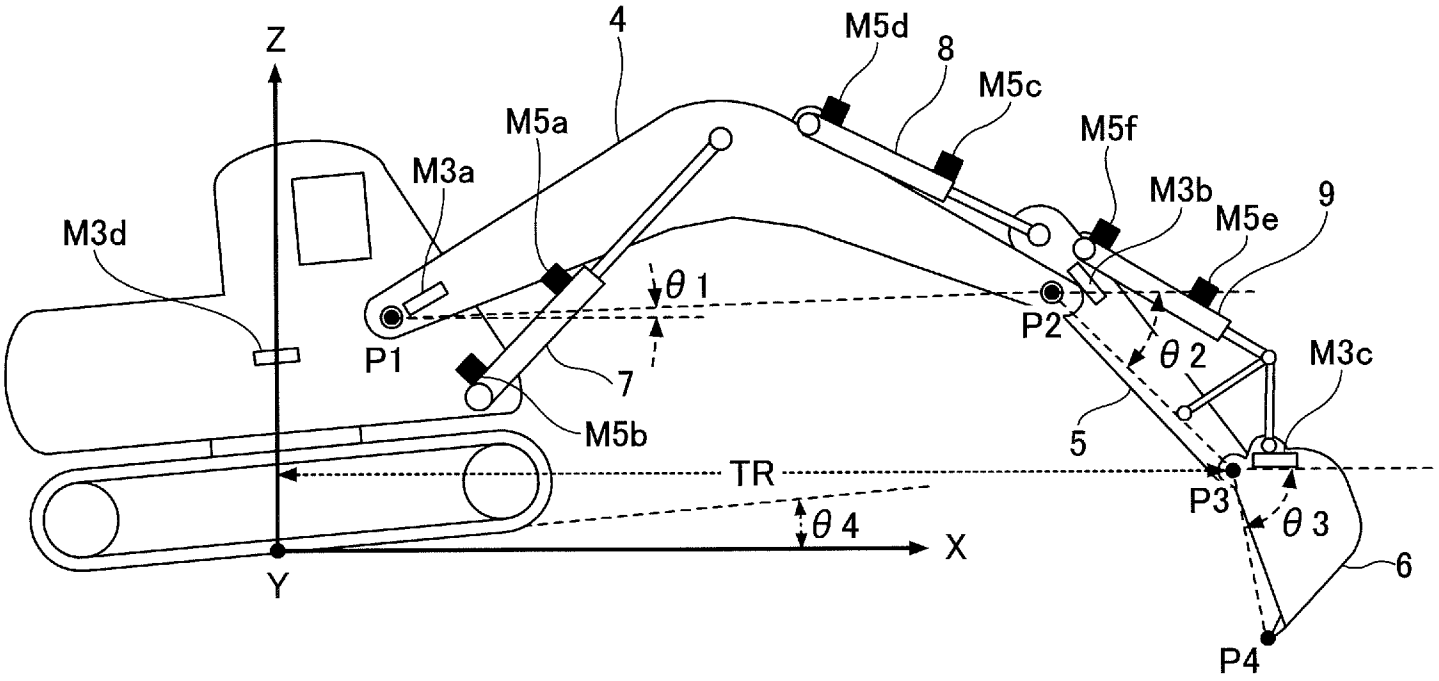
FIG. 2 is a side view of a shovel illustrating an example of a configuration of an attitude detector mounted on a shovel in FIG. 1.

FIG. 2 is a side view of the shovel in FIG. 1, which illustrates an example of output contents of various sensors constituting the attitude detector M3 and the cylinder pressure detector M5 mounted on the shovel. Specifically, the attitude detector M3 includes a boom angle sensor M3*a*, an arm angle sensor M3*b*, a bucket angle sensor M3*c*, and a body tilt sensor M3*d*. The cylinder pressure detector M5 includes a boom rod pressure sensor M5*a*, a boom bottom pressure sensor M5*b*, an arm rod pressure sensor M5*c*, an arm bottom pressure sensor M5*d*, a bucket rod pressure sensor M5*e*, and a bucket bottom pressure sensor M5*f*. In FIG. 2, the X-axis is included in the horizontal plane and the Z-axis corresponds to the pivot.

The boom angle sensor M3*a* is configured to obtain the boom angle. The boom angle sensor M3*a* includes at least one of a rotation angle sensor to detect the rotation angle of a boom foot pin, a stroke sensor to detect the stroke amount of the boom cylinder 7, a tilt (acceleration) sensor to detect the tilt angle of the boom 4, and the like. The boom angle sensor M3*a* obtains, for example, a boom angle θ1. The boom angle θ1 is, for example, an angle to the horizontal line of a line segment P1 to P2 that connects a boom foot pin position P1 and an arm connection pin position P2 in the XZ plane.

The arm angle sensor M3*b* is configured to obtain an arm angle. The arm angle sensor M3*b* includes, for example, at least one of a rotation angle sensor to detect the rotation angle of an arm connection pin, a stroke sensor to detect the stroke amount of the arm cylinder 8, and a tilt (acceleration) sensor to detect the tilt angle of the arm 5. The arm angle sensor M3*b* obtains, for example, an arm angle θ2. The arm angle θ2 is, for example, an angle to the horizontal line of a line segment P2 to P3 that connects the arm connection pin position P2 and a bucket connection pin position P3 in the XZ plane. In the present embodiment, the distance between the bucket connection pin position P3 and the Z-axis (pivot) represents an attachment length TR.

The bucket angle sensor M3*c* is configured to obtain a bucket angle. The bucket angle sensor M3*c* includes at least one of a rotation angle sensor to detect the rotation angle of a bucket connection pin, a stroke sensor to detect the stroke amount of the bucket cylinder 9, and a tilt (acceleration) sensor to detect the tilt angle of the bucket 6. The bucket angle sensor M3*c* obtains, for example, a bucket angle θ3. The bucket angle θ3 is, for example, an angle to the horizontal line of a line segment P3 to P4 that connects the bucket connection pin position P3 and a bucket teeth end position P4 in the XZ plane.

The boom angle sensor M3*a*, the arm angle sensor M3*b*, and the bucket angle sensor M3*c* may be constituted with a combination of acceleration sensors and gyro sensors.

The body tilt sensor M3*d* is configured to obtain a tilt angle 84 of the shovel around the Y-axis and a tilt angle θ5 (not illustrated) of the shovel around the X-axis. The body tilt sensor M3*d* includes, for example, at least one of a biaxial tilt (acceleration) sensor, a triaxial tilt (acceleration) sensor, and the like. Note that the XY plane in FIG. 2 is the horizontal plane.

The boom rod pressure sensor M5*a* detects the pressure in an oil chamber on the rod side of the boom cylinder 7 (hereafter, referred to as the "boom rod pressure"), and the boom bottom pressure sensor M5*b* detects the pressure in an oil chamber on the bottom side of the boom cylinder 7 (hereafter, referred to as the "boom bottom pressure"). The arm rod pressure sensor M5*c* detects the pressure in an oil chamber on the rod side of the arm cylinder 8 (hereafter, referred to as the "arm rod pressure"), and the arm bottom pressure sensor M5*d* detects the pressure in an oil chamber on the bottom side of the arm cylinder 8 (hereafter, referred to as the "arm bottom pressure"). The bucket rod pressure sensor M5*e* detects the pressure in an oil chamber on the rod side of the bucket cylinder 9 (hereafter, referred to as the "bucket rod pressure"), and the bucket bottom pressure sensor M5*f* detects the pressure in an oil chamber on the bottom side of the bucket cylinder 9 (hereafter, referred to as the "bucket bottom pressure").

Figure 3:
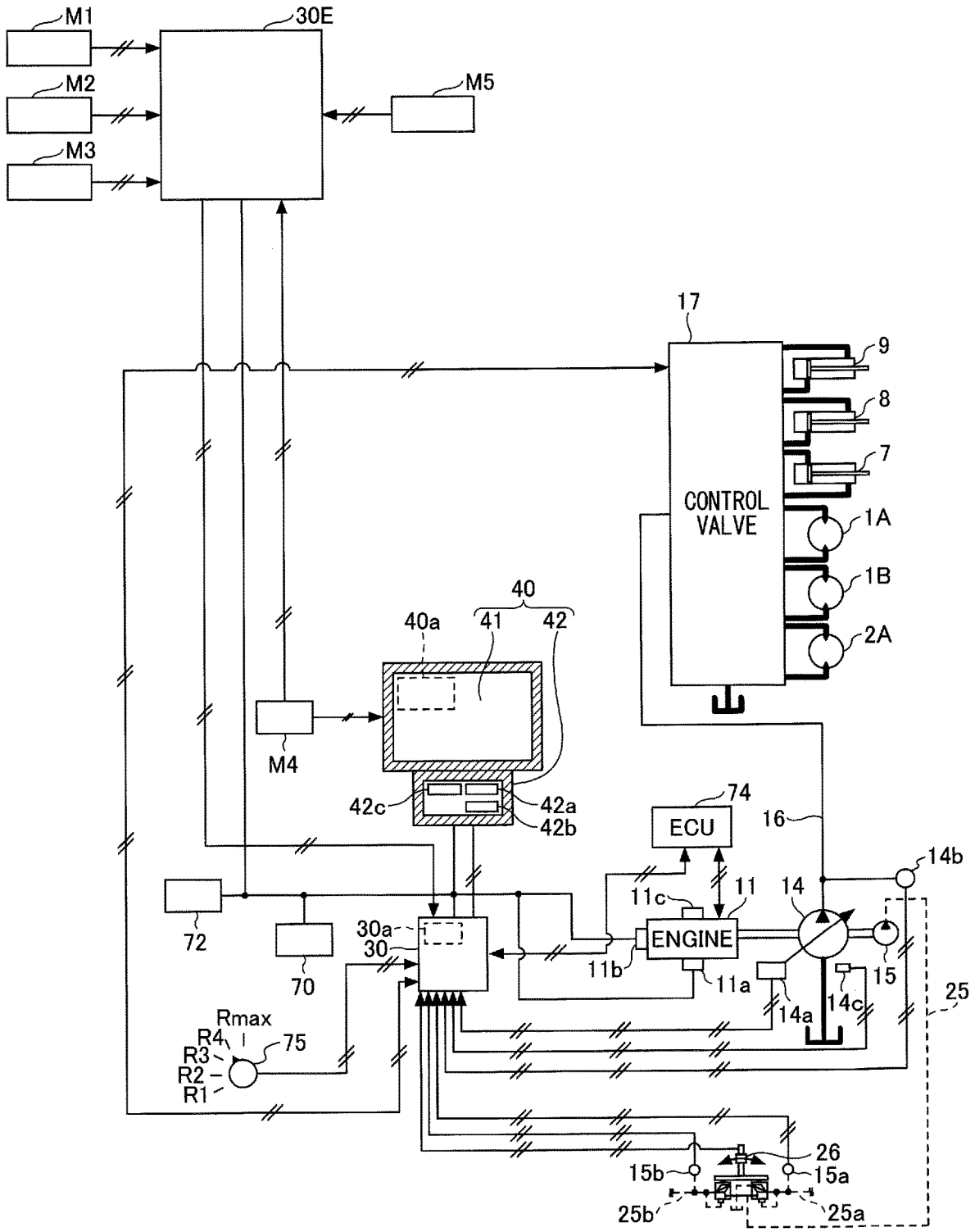
FIG. 3 is a diagram illustrating an example of a configuration of a basic system installed in a shovel in FIG. 1.

Next, with reference to FIG. 3, a basic system of the shovel will be described. The basic system of the shovel primarily includes an engine 11, a main pump 14, a pilot pump 15, control valves 17, an operational device 26, a controller 30, and an engine control unit (ECU) 74.

The engine 11 is a driving source of the shovel, for example, a diesel engine that operates to maintain a predetermined number of revolutions. The output shaft of the engine 11 is connected to the respective input shafts of the main pump 14 and the pilot pump 15.

The main pump 14 is configured to supply the hydraulic operating fluid to the control valves 17 through a hydraulic operating fluid line 16. The main pump 14 is, for example, a swash-plate-based variable capacity hydraulic pump. The main pump 14 can adjust the stroke length of the piston in response to a change in the angle (tilt angle) of the swash plate, to change the discharge amount, namely, the pump output. The swash plate of the main pump 14 is controlled by a regulator 14*a*. The regulator 14*a* changes the tilt angle of the swash plate in response to a change in the control current output by the controller 30. The regulator 14*a* increases the tilt angle of the swash plate, for example, in response to an increase in the control current, to increase the discharge amount of the main pump 14. Also, the regulator 14*a* decreases the tilt angle of the swash plate in response to a decrease in the control current, to decrease the discharge amount of the main pump 14.

The pilot pump 15 is configured to supply the hydraulic operating fluid to various hydraulic control devices through a pilot line 25. The pilot pump 15 is, for example, a fixed-capacity hydraulic pump.

The control valves 17 are hydraulic control valves that control the hydraulic system. The control valves 17 selectively supply the hydraulic operating fluid supplied from, for example, the main pump 14 through the hydraulic operating fluid line 16 to one or more of the boom cylinder 7, the arm cylinder 8, the bucket cylinder 9, a hydraulic motor 1A for leftward traveling, a hydraulic motor 1B for rightward traveling, and a hydraulic motor 2A for revolving. In the following description, the boom cylinder 7, the arm cylinder 8, the bucket cylinder 9, the hydraulic motor 1A for leftward traveling, the hydraulic motor 1B for rightward traveling, and the hydraulic motor 2A for revolving are collectively referred to as the "hydraulic actuators".

The operational device 26 is a device used by an operator to operate the hydraulic actuators. The operational device 26 includes a lever and a pedal. The operational device 26 receives a supply of the hydraulic operating fluid from the pilot pump 15 through the pilot line 25. Then, the operational device 26, supplies the hydraulic operating fluid to the pilot ports of the flow control valves corresponding to the respective hydraulic actuators through the pilot lines 25*a* and 25*b*. The pressure (pilot pressure) of the hydraulic operating fluid supplied to each of the pilot ports corresponds to the operational direction and amount of the operational device 26 corresponding to each of the hydraulic actuators.

The controller 30 is a control device for controlling the shovel and is constituted with a computer that includes, for example, a CPU, a RAM, a ROM, and the like. The CPU of the controller 30 reads programs corresponding to functions of the shovel from the ROM, loads, and executes the programs on the RAM, so as to realize the functions corresponding to these programs.

Specifically, the controller 30 controls, for example, the discharge amount of the main pump 14. The controller 30 changes the control current, for example, in response to a negative control pressure of a negative control valve (not illustrated), to control the discharge amount of the main pump 14 via the regulator 14*a*.

The engine control unit (ECU) 74 is configured to control the engine 11. The engine control unit (ECU) 74 outputs to the engine 11 a fuel injection amount and the like for realizing the number of revolutions of the engine set by an operator using an engine revolution adjustment dial 75 (mode), for example, based on a command from the controller 30.

Figure 4:
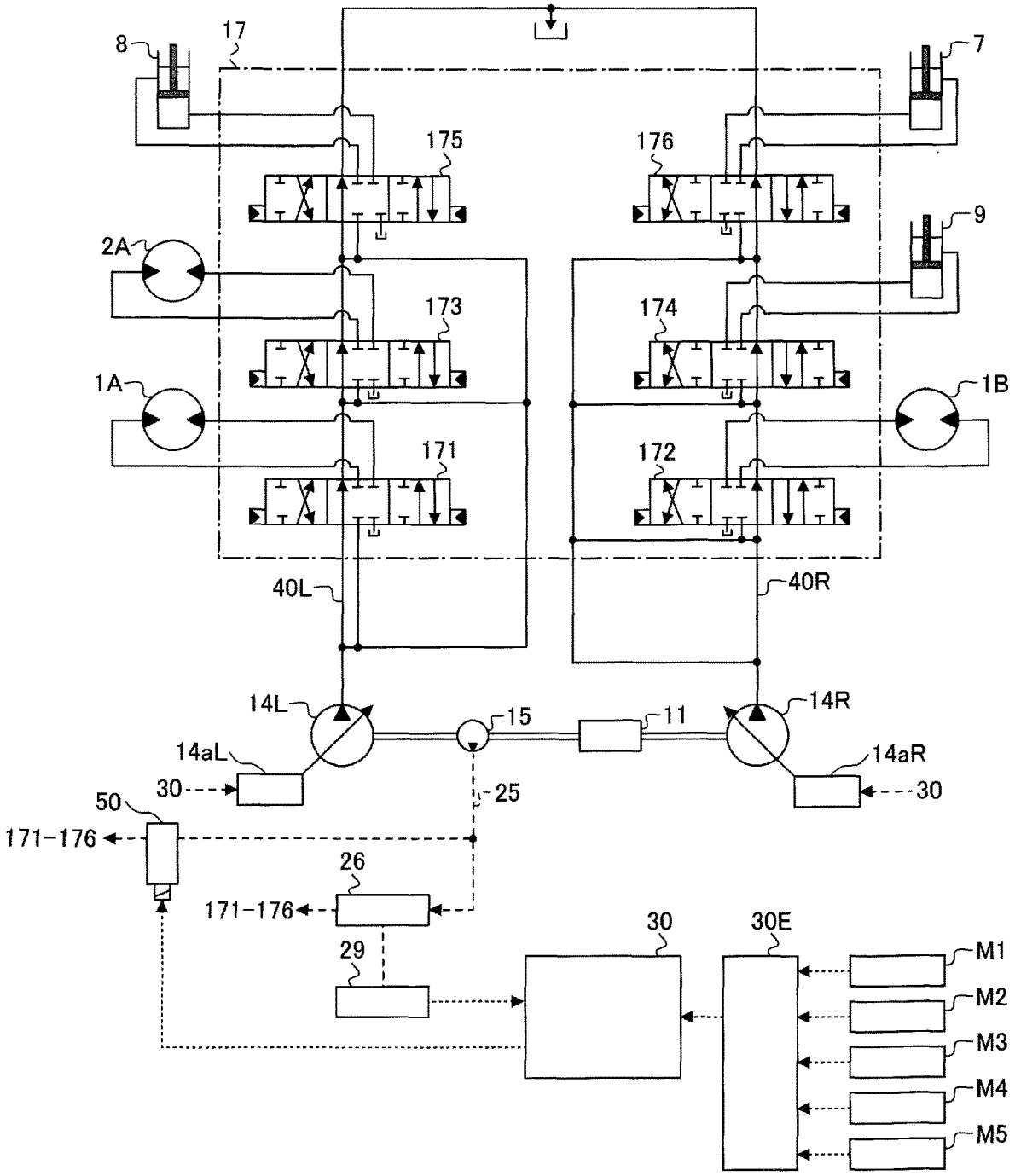
FIG. 4 is a diagram illustrating an example of a configuration of a drive system installed in a shovel in FIG. 1.

The engine revolution adjustment dial 75 is a dial for adjusting the number of revolutions of the engine, which is provided in the cabin 10, and in the present embodiment, configured to be capable of switching the number of revolutions of the engine in five stages, Rmax, R4, R3, R2, and R1. Note that FIG. 4 illustrates a state in which R4 is selected on the engine revolution adjustment dial 75.

Rmax is the highest number of revolutions of the engine 11, which is selected in the case where it is desirable to prioritize the workload. R4 is the second highest number of revolutions of the engine, which is selected in the case where it is desirable to achieve both the workload and the fuel economy. R3 is the third highest number of revolutions of the engine, which is selected in the case where it is desirable to operate the shovel while prioritizing the fuel economy with low noise. R2 is the fourth highest number of revolutions of the engine, which is selected in the case where it is desirable to operate the shovel while prioritizing the fuel economy with low noise. R1 is the lowest number of revolutions of the engine (idling revolutions), which is selected in the case where it is desirable to put the engine 11 in an idling state. In the present embodiment, Rmax, R4, R3, R2, and R1 are 2000 rpm, 1750 rpm, 1500 rpm, 1250 rpm, and 1000 rpm, respectively. Then, the number of revolutions of the engine 11 is controlled to be stable at the number of revolutions of the engine set with the engine revolution adjustment dial 75. The number of revolutions of the engine that can be selected with the engine revolution adjustment dial 75 may be other than five.

Near the driver's seat in the cabin 10, an image display device 40 is provided to assist operations of the shovel performed by the operator. In the present embodiment, the image display device 40 is fixed to a console within the cabin 10. The image display device 40 includes an image display unit 41 and an input unit 42. The image display unit 41 displays information on an operational state of the shovel or control of the shovel, and thereby, can inform the operator of such information items. Also, the operator can use the input unit 42 to input various information items into the controller 30. Generally, the boom 4 is arranged on the right side of the operator seated on the driver's seat, and it is often the case that the operator operates the shovel while visually recognizing the arm 5 and the bucket 6 attached to the end of the boom 4. Although a frame in front of the cabin 10 on the right side is a portion that hinders the view of the operator, in the present embodiment, this portion is used for providing the image display device 40. Thus, the image display device 40 is provided at the portion that hinders the view in the first place, and hence, the image display device 4 by itself does not significantly hinder the view of the operator. Depending on the width of the frame, the image display device 40 may be configured to be vertically longer so that the entire image display unit 41 fits within the width of the frame.

In the present embodiment, the image display device 40 is connected to the controller 30 via a communication network such as a CAN or LIN. Note that the image display device 40 may be connected to the controller 30 via a dedicated line. The image display device 40 includes a conversion processing unit 40*a* to generate an image to be displayed on the image display unit 41. In the present embodiment, the conversion processing unit 40*a* generates a camera image to be displayed on the image display unit 41, based on the output of the imaging device M4 attached to the shovel. Therefore, the imaging device M4 is connected to the image display device 40, for example, via a dedicated line. Also, the conversion processing unit 40*a* generates an image to be displayed on the image display unit 41, based on the output of the controller 30.

The conversion processing unit 40*a* may be implemented as a function of the controller 30, instead of a function included in the image display device 40. In this case, the imaging device M4 is connected to the controller 30 instead of the image display device 40.

The image display device 40 may include a switch panel as the input unit 42. The switch panel is a panel including various hardware switches. In the present embodiment, the switch panel includes a light switch 42*a*, a wiper switch 42*b*, and a window washer switch 42*c* as hardware buttons. The light switch 42*a* is a switch for switching between turning on and off of lights attached to the outside of the cabin 10. The wiper switch 42*b* is a switch for switching between activation and stoppage of the wiper. The window washer switch 42*c* is a switch for spraying window washer liquid.

The image display device 40 operates on power supplied from a storage battery 70. The storage battery 70 is charged by power generated by an alternator 11*a* (dynamo). The power of the storage battery 70 is also supplied to electric parts 72 and the like of the shovel, other than the controller 30 and the image display device 40. A starter 11*b* of the engine 11 is driven by the power from the storage battery 70, to start the engine 11.

As described above, the engine 11 is controlled by the engine control unit (ECU) 74. The ECU 74 transmits various data items representing states of the engine 11 (for example, data representing cooling water temperature (a physical quantity) detected by a water temperature sensor 11*c*), to the controller 30. Therefore, the controller 30 may store such data items in a temporary storage unit (a memory) 30*a*, to be capable of transmitting the data items to the image display device 40 when necessary.

Also, various types of data items are supplied to the controller 30 as follows. These data items are stored in the temporary storage unit 30*a* of the controller 30.

The regulator 14*a* supplies data representing the tilt angle of the swash plate to the controller 30. The regulator 14*a* also supplies data representing the discharge pressure of the main pump 14 to the controller 30 from a discharge pressure sensor 14*b*. These data items (data items representing physical quantities) are stored in the temporary storage unit 30*a*. An oil temperature sensor 14*c* is provided on a conduit between the main pump 14 and a tank in which hydraulic operating fluid suctioned by the main pump 14 is stored, and data representing the temperature of the hydraulic operating fluid that flows through the conduit is supplied to the controller 30 from the oil temperature sensor 14*c*.

Also, pilot pressure transmitted to the control valves 17 through the pilot lines 25*a* and 25*b* when the operational device 26 is operated is detected by oil pressure sensors 15*a* and 15*b*, and data representing the detected pilot pressure is supplied to the controller 30.

From the engine revolution adjustment dial 75, data representing the setting state of the number of revolutions of the engine is transmitted to the controller 30.

An external processing device 30E is a control device that performs various arithmetic/logic operations based on outputs of the communication device M1, the positioning device M2, the attitude detector M3, the imaging device M4, and the cylinder pressure detector M5, to output the calculation result to the controller 30. In the present embodiment, the external processing device 30E operates on power supplied from the storage battery 70.

FIG. 4 is a diagram illustrating an example of a configuration of a drive system installed in the shovel in FIG. 1, in which dual lines, solid lines, dashed lines, and dotted lines designate mechanical power transmission lines, hydraulic operating fluid lines, pilot lines, and electrical control lines, respectively.

The drive system of the shovel primarily includes an engine 11, main pumps 14L and 14R, discharge amount adjusters 14*a*L and 14*a*R, a pilot pump 15, control valves 17, an operational device 26, an operational content detector 29, a controller 30, an external processing device 30E, and a pilot pressure adjuster 50. The main pumps 14L and 14R correspond to the main pump 14 in FIG. 3. The discharge amount adjustors 14*a*L and 14*a*R correspond to the regulator 14*a* in FIG. 3.

The control valves 17 include flow control valves 171 to 176 that control the flow of the hydraulic operating fluid discharged by the main pumps 14L and 14R. Then, the control valves 17 selectively supply the hydraulic operating fluid discharged by the main pumps 14L and 14R to one or more of the boom cylinder 7, the arm cylinder 8, the bucket cylinder 9, the hydraulic motor 1A for leftward traveling, the hydraulic motor 1B for rightward traveling, and the hydraulic motor 2A for revolving, through the flow control valves 171 to 176.

In the present embodiment, through the pilot line 25, the operational device 26 supplies the hydraulic operating fluid discharged by the pilot pump 15 to the pilot ports of the flow control valves corresponding to the respective hydraulic actuators.

The operational content detector 29 is configured to detect the content of an operation performed by the operator using the operational device 26. In the present embodiment, the operational content detector 29 detects the operational direction and amount of an operation on the operational device 26 corresponding to each of the hydraulic actuators in a form of pressure, and outputs the detected values to the controller 30. The content of an operation may be derived using the output of the other sensors other than the pressure sensor, such as a potentiometer.

The main pumps 14L and 14R driven by the engine 11 circulate the hydraulic operating fluid through center bypass conduits 40L and 40R, respectively, to a hydraulic operating fluid tank.

The center bypass conduit 40L is a hydraulic operating fluid line passing through the flow control valves 171, 173, and 175 arranged in the control valves 17, and the center bypass conduit 40R is a hydraulic operating fluid line passing through the flow control valves 172, 174, and 176 arranged in the control valves 17.

The flow control valves 171, 172, and 173 are spool valves that control the flow rate and flow direction of the hydraulic operating fluid flowing into and out of the hydraulic motor 1A for leftward traveling, the hydraulic motor 1B for rightward traveling, and the hydraulic motor 2A for revolving.

The flow control valves 174, 175, and 176 are spool valves that control the flow rate and flow direction of the hydraulic operating fluid flowing into and out of the bucket cylinder 9, the arm cylinder 8, and the boom cylinder 7.

The discharge amount adjustors 14*a*L and 14*a*R are configured to adjust the discharge amounts of the main pumps 14L and 14R, respectively. In the present embodiment, the discharge amount adjuster 14*a*L is a regulator, which adjusts the discharge amount of the main pump 14L by increasing or decreasing the tilt angle of the swash plate of the main pump 14L so as to increase or decrease the displaced volume in the main pump 14L in response to a control command from the controller 30.

Specifically, the discharge amount adjuster 14*a*L increases the discharge amount of the main pump 14L by increasing the tilt angle of the swash plate to increase the displaced volume while the control current output by the controller 30 increases. The same applies to the discharge amount of the main pump 14R adjusted by the discharge amount adjuster 14*a*R.

Figure 5:
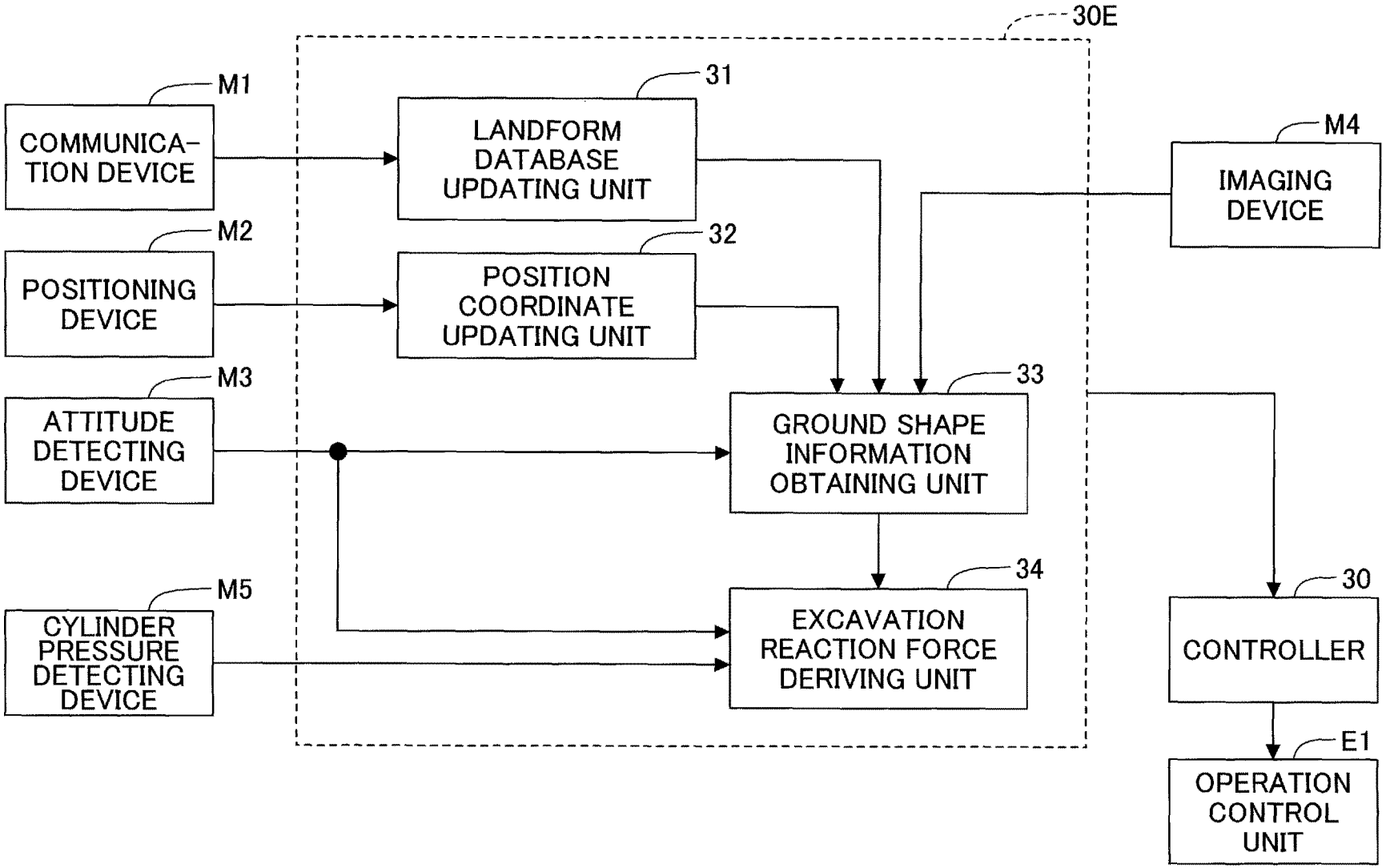
FIG. 5 is a diagram illustrating an example of a configuration of an external processing device.

The pilot pressure adjuster 50 is configured to adjust the pilot pressure supplied to the pilot ports of the flow control valves. In the present embodiment, the pilot pressure adjuster 50 is a pressure reducing valve that increases or decreases the pilot pressure by using the hydraulic operating fluid discharged by the pilot pump 15 in response to the control current output by the controller 30. This configuration enables the pilot pressure adjuster 50 to open and close the bucket 6 in response to the control current from the controller 30, regardless of, for example, an operation on a bucket operation lever performed by the operator. Also, regardless of an operation on a boom operation lever performed by the operator, the boom 4 can be raised or lowered in response to the control current from the controller 30. The same applies to a forward movement or backward movement of the traveling lower body 1; a left revolution or right revolution of the revolving upper body 3; opening and closing of the arm 5; and the like. Next, with reference to FIG. 5, functions of the external processing device 30E will be described. FIG. 5 is a functional block diagram illustrating an example of a configuration of the external processing device 30E. In the present embodiment, the external processing device 30E receives at least one of the outputs of the communication device M1, the positioning device M2, the attitude detector M3, the imaging device M4, and the cylinder pressure detector M; performs various operations on the outputs; and outputs the calculation result to the controller 30. The controller 30 outputs, for example, a control command according to the calculation result to an operation control unit E1.

The operation control unit E1 is a functional element for controlling the movement of the attachment, and includes, for example, the pilot pressure adjuster 50 and the flow control valves 171 to 176. In the case where the flow control valves 171 to 176 are configured to operate in response to electrical signals, the controller 30 directly transmits electrical signals to the flow control valves 171 to 176.

The operation control unit E1 may include an information indicating device that informs the operator of the shovel that the motion of the attachment has been automatically adjusted. The information indicating device includes, for example, an audio output device, an LED lamp, and the like.

Specifically, the external processing device 30E primarily includes a landform database updating unit 31, a position coordinate updating unit 32, a ground shape information obtaining unit 33, and an excavation reaction force deriving unit 34.

The landform database updating unit 31 is a functional element for updating a landform database that systematically stores landform information of a worksite, to which reference can be made. In the present embodiment, the landform database updating unit 31 updates the landform database by obtaining the landform information of a worksite through the communication device M1, for example, when the shovel is started up. The landform database is stored, for example, in a non-volatile memory or the like. The landform information of a worksite is described in a three-dimensional landform model based on, for example, the world geodetic system.

The position coordinate updating unit 32 is a functional element to update the coordinates representing the current position of the shovel. In the present embodiment, the position coordinate updating unit 32 obtains the position coordinates and direction of the shovel in the world geodetic system based on the output of the positioning device M2, to update data related to the coordinates and direction representing the current position of the shovel stored in the non-volatile memory or the like.

The ground shape information obtaining unit 33 is a functional element to obtain information on the current shape of a target excavation ground. In the present embodiment, the ground shape information obtaining unit 33 obtains information on the current shape of a target excavation ground, based on the landform information updated by the landform database updating unit 31; the coordinates and direction representing the current position of the shovel updated by the position coordinate updating unit 32; and past transitions in the attitude of the excavation attachment detected by the attitude detector M3.

The ground shape information obtaining unit 33 may also obtain the information on the current shape of the target excavation ground, based on an image around the shovel captured by the imaging device M4. The ground shape information obtaining unit 33 may also obtain the information on the current shape of the target excavation ground, based on the output of a distance measurement device such as a laser rangefinder, laser scanner, distance image sensor, lider, or the like.

The excavation reaction force deriving unit 34 is a functional element to derive excavation reaction force. The excavation reaction force deriving unit 34 derives the excavation reaction force based on, for example, the attitude of the excavation attachment and the information on the current shape of the target excavation ground. The attitude of the excavation attachment is detected by the attitude detector M3, and the information on the current shape of the target excavation ground is obtained by the ground shape information obtaining unit 33. The excavation reaction force deriving unit 34 may derive the excavation reaction force, based on the attitude of the excavation attachment and information output by the cylinder pressure detector M5. Also, the excavation reaction force deriving unit 34 may derive the excavation reaction force, based on the attitude of the excavation attachment, the information on the current shape of the target excavation ground, and the information output by the cylinder pressure detector M5.

In the present embodiment, the excavation reaction force deriving unit 34 derives the excavation reaction force at predetermined calculation cycles, by using a predetermined calculation formula. For example, the excavation reaction force deriving unit 34 derives the excavation reaction force to be greater when the excavation depth is deeper, namely, when the vertical distance between the ground plane of the shovel and the bucket teeth end position P4 (see FIG. 2) is greater. Also, the excavation reaction force deriving unit 34 derives the excavation reaction force, for example, to be greater when the insertion depth into the ground is greater with respect to the target excavation ground of the teeth end of the bucket 6. Also, the excavation reaction force deriving unit 34 may derive the excavation reaction force taking into account characteristics of earth and sand such as the density of earth and sand. A characteristic of earth and sand may be a value input by an operator through an on-shovel input device (not illustrated) or may be a value automatically calculated based on outputs of the various sensors such as the cylinder pressure sensors.

The excavation reaction force deriving unit 34 may determine whether excavation is in progress based on the attitude of the excavation attachment and the information on the current shape of the target excavation ground, to output the determination result to the controller 30. The excavation reaction force deriving unit 34 determines that excavation is in progress, for example, when the vertical distance between the bucket teeth end position P4 (see FIG. 2) and the target excavation ground becomes less than or equal to a predetermined value. The excavation reaction force deriving unit 34 may determine that excavation is in progress before the teeth end of the bucket 6 contacts the target excavation ground.

Figure 6:
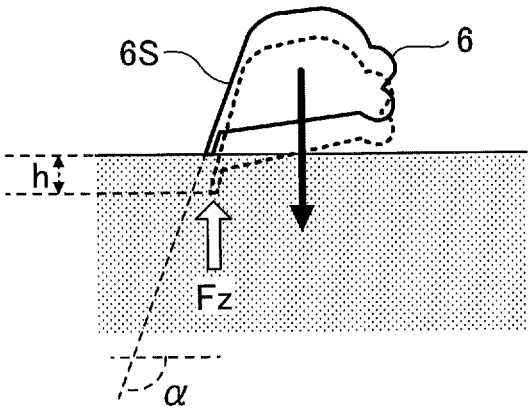
FIG. 6 illustrates a relationship between a bucket and a target excavation ground in an initial excavation stage.

Here, with reference to FIG. 6, an initial excavation stage will be described. FIG. 6 illustrates a relationship between the bucket 6 and the target excavation ground in an initial excavation stage.

The initial excavation stage means a stage of moving the bucket 6 vertically downward as designated by an arrow in FIG. 6. Therefore, the excavation reaction force Fz in the initial excavation stage is primarily constituted with an insertion resistance when inserting the teeth end of the bucket 6 into the target excavation ground and is primarily directed vertically upward. The insertion resistance becomes greater while the insertion depth of the bucket 6 into the ground (hereafter, referred to as the "insertion depth h") becomes greater. The insertion depth into the ground is also referred to as the teeth end penetration depth or penetration depth. Under the same insertion depth h of the teeth end of the bucket 6, the insertion resistance becomes minimum when the bucket teeth end angle $\alpha$ is approximately 90 degrees. The bucket teeth end angle $\alpha$ is an angle of the teeth end of the bucket 6 with respect to the target excavation ground and is also referred to as the penetration angle. Typically, it is an angle formed between a plane including the bottom face (back face) 6S of the bucket 6 and the target excavation ground. The external processing device 30E calculates the bucket teeth end angle $\alpha$ based on the output of the attitude detector M3 and the information on the current shape of the target excavation ground. Note that the external processing device 30E determines that the current excavation stage is the initial excavation stage, for example, in the case of having determined that a downward boom operation is being performed during the excavation.

The external processing device 30E derives hardness K of an excavation target, based on the insertion depth h and the insertion resistance (excavation reaction force Fz) of the teeth end of the bucket 6 in the initial excavation stage, when the bucket 6 is pressed against the ground at a predetermined bucket teeth end angle $\alpha$ with a predetermined force. In the present embodiment, the external processing device 30E derives the hardness K of an excavation target with reference to a hardness table that stores a corresponding relationship between the insertion depth h, the excavation reaction force Fz, and the hardness K.

The hardness K may be derived by using a predetermined formula. Then, the external processing device 30E stores the derived hardness K in the non-volatile memory or the like. In the case of deriving multiple values of the hardness K for one target excavation ground, a mean of these values may be set as the hardness K, or the latest value may be set as the hardness K. Another statistic such as a maximum, minimum, or median value may be set as the hardness K. Also, in the case where the operator has obtained in advance a measured value of the hardness of the ground of the work area to be excavated, the operator may enter the measured value as the hardness K through an on-shovel input device or the like.

The external processing device 30E may control the insertion depth h of the teeth end of the bucket 6 when deriving the hardness K. Specifically, the external processing device 30E may drive the attachment so that the insertion depth h of the teeth end of the bucket 6 when deriving the hardness K becomes a predetermined insertion depth.

The external processing device 30E may display information on the hardness K of the target excavation ground on the image display device 40. Also, the external processing device 30E may store the information on the hardness K of the target excavation ground in the landform database. Also, the external processing device 30E may transmit the information on the hardness K of the target excavation ground to an external device. The external device includes, for example, at least one of a management device installed at a management center, a support device such as a smartphone carried by an operator of the shovel or an involved person including a worker working around the shovel, and the like.

The insertion depth h is derived by the excavation reaction force deriving unit 34 based on, for example, information on the bucket teeth end position and the current shape of the target excavation ground. The excavation reaction force Fz is derived by the excavation reaction force deriving unit 34 based on, for example, the attitude of the excavation attachment and the information output by the cylinder pressure detector M5.

Figure 7:
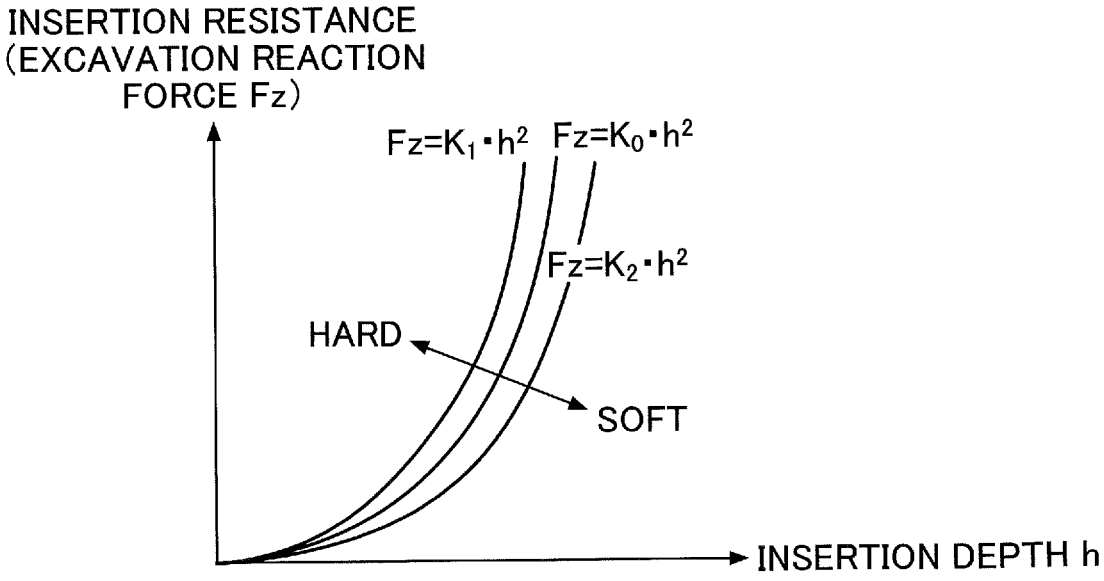
FIG. 7 is a graph illustrating a corresponding relationship stored in a hardness table.

FIG. 7 is a graph representing a corresponding relationship stored in the hardness table in which the insertion resistance (excavation reaction force Fz) is arranged along the vertical axis and the insertion depth h is arranged along the horizontal axis. As illustrated in FIG. 7, the insertion resistance (excavation reaction force Fz) is represented as a function proportional to, for example, the square of the insertion depth h. Coefficients $K_0$, $K_1$, and $K_2$ are examples of the hardness K, and a greater value represents a higher hardness. For example, if the hardness K is greater than or equal to $K_0$ (e.g., in the case of $K_1$), it is determined hard; or if the hardness K is less than $K_0$ (e.g., in the case of $K_2$), it is determined not hard (soft). It may be determined in three or more stages instead of in two stages of being hard or soft.

The external processing device 30E derives the hardness K based on, for example, the insertion depth h and the insertion resistance (excavation reaction force Fz), derived by the excavation reaction force deriving unit 34 and a corresponding relationship as illustrated in FIG. 7.

The external processing device 30E may derive the hardness K from the tilt angle $\theta$4 (floating angle) around the Y-axis of the shovel when the boom 4 is lowered with a predetermined attitude of the excavation attachment or at a predetermined bucket teeth end angle and with a predetermined boom rod pressure to pierce the teeth end of the bucket 6 into the target excavation ground. In this case, with a greater tilt angle $\theta$4 (see FIG. 2), a greater hardness K is derived.

The external processing device 30E may derive the hardness K from the density of earth and sand. For example, the external processing device 30E may derive the hardness K from a unit volume weight (the density of earth and sand) of the excavation target that has been taken into the bucket 6, which is calculated from the boom bottom pressure and the like. In this case, the corresponding relationship between the density of earth and sand and the hardness K may be stored in advance, for example, in the non-volatile memory.

The external processing device 30E may combine two or more of results derived by the methods described above to derive the hardness K. Alternatively, instead of deriving the hardness K of the excavation target as a numerical value, the external processing device 30E may select the hardness K of the excavation target from among multiple hardness stages.

In this way, the external processing device 30E derives the hardness K of the excavation target, for example, by performing trial excavation. Then, the external processing device 30E supports the excavation operation using the excavation attachment, based on the hardness K of the excavation target.

The hardness K may be a value entered by the operator through an on-shovel input device (not illustrated) such as a touch panel. The value entered by the operator may be, for example, the type of excavation target such as sand, rock, or soil, or a value related to a soil property of excavation target, or the like; or may be a value of the hardness measured by using a measuring instrument such as a hardness meter.

Figure 8:
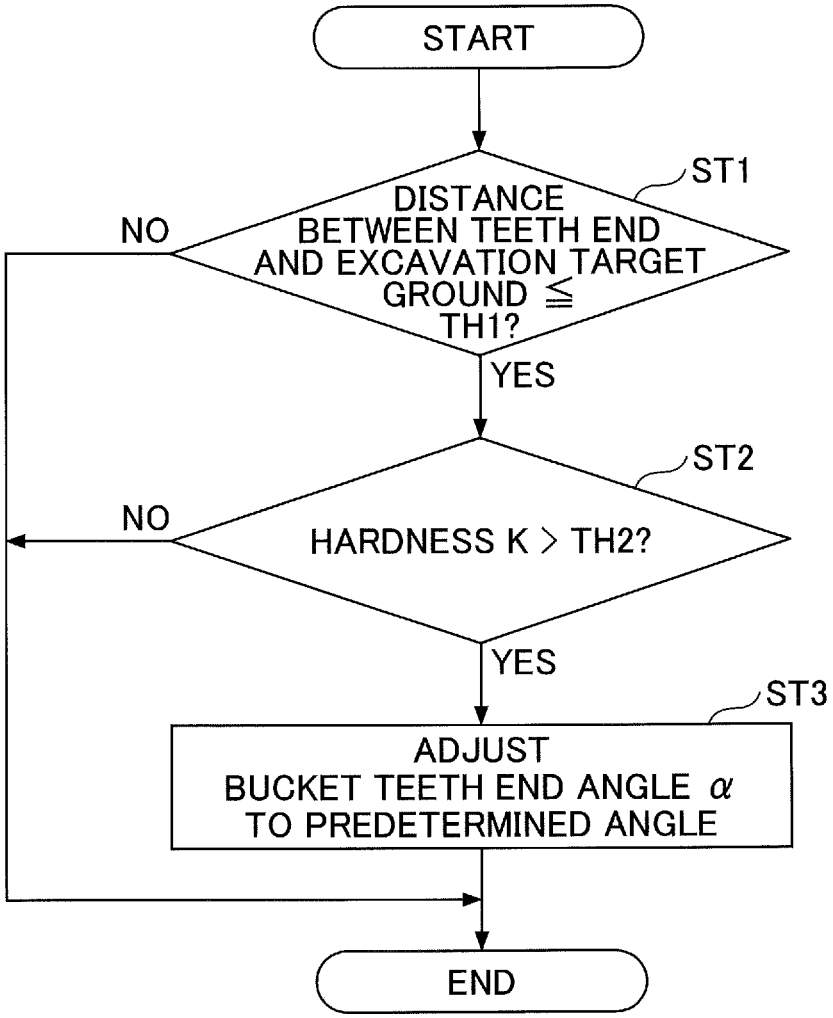
FIG. 8 is a flow chart illustrating an example of an excavation support operation.

Next, with reference to FIG. 8, an example of an operation in which the external processing device 30E supports excavation operations by the excavation attachment (hereafter, referred to as the "excavation support operation") will be described. FIG. 8 is a flow chart illustrating an example of an excavation support operation. The external processing device 30E repeatedly performs this excavation support operation at predetermined control cycles while the shovel is in operation.

First, at Step ST1, the external processing device 30E determines whether the distance between the teeth end of the bucket 6 and the target excavation ground is less than or equal to a threshold TH1, based on the attitude of the excavation attachment.

If having determined that the distance is greater than the threshold TH1 (NO at Step ST1), the external processing device 30E terminates the excavation support operation without supporting the excavation operation. This is because at this moment, it is possible to determine that the teeth end of the bucket 6 does not contact the target excavation ground.

On the other hand, if having determined that the distance is less than or equal to the threshold value TH1 (YES of Step ST1), at Step ST2, the external processing device 30E determines whether or not the hardness K of the excavation target is greater than a predetermined hardness TH2. In the present embodiment, the external processing device 30E reads the hardness K stored in the non-volatile memory during trial excavation, to compare the hardness K with the predetermined hardness TH2. The predetermined hardness TH2 corresponds to, for example, the coefficient K0 in FIG. 7.

If having determined that the hardness K of the excavation target is greater than the predetermined hardness TH2 (YES at Step ST2), at Step ST3, the external processing device 30E adjusts the bucket teeth end angle $\alpha$ to a predetermined angle (e.g., 90 degrees). In the present embodiment, the external processing device 30E drives the attachment so that the bucket teeth end angle $\alpha$ becomes a predetermined angle. Specifically, the external processing device 30E causes at least one of the boom 4, the arm 5 and the bucket 6 to operate automatically or semi-automatically. Here, "to operate automatically" means performing an operation irrespective of the operational amount of the operational device 26. Also, "to operate semi-automatically" means performing an operation in a way that compensates the operational amount of the operational device 26.

If having determined that the hardness K of the excavation target is less than or equal to the predetermined hardness TH2 (NO at ST2), the external processing device 30E terminates the excavation support operation without supporting the excavation operation. This is because the target excavation ground is sufficiently soft and there is no need to support the excavation operation, namely, it is possible to determine that the bucket teeth end angle $\alpha$ does not need to be limited to the predetermined angle.

Figure 9:
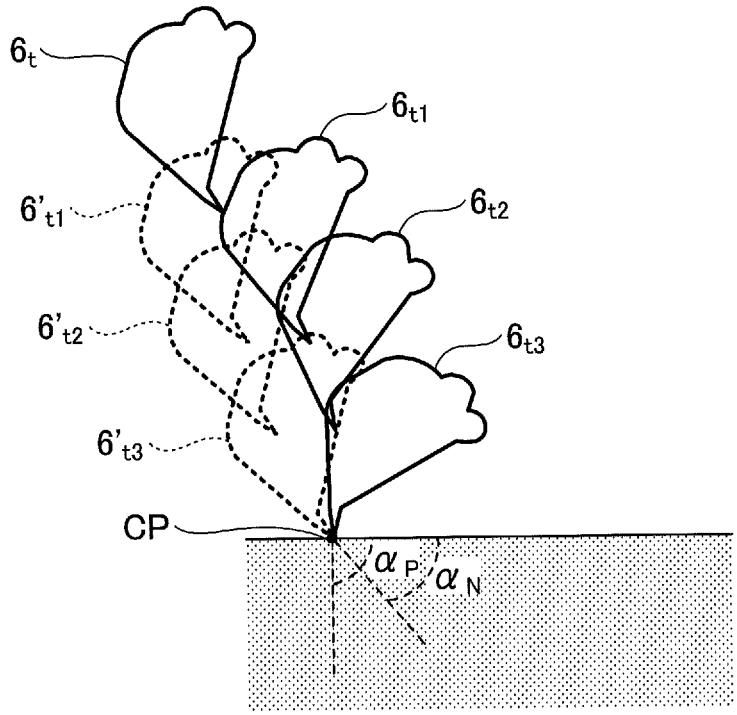
FIG. 9 is a diagram illustrating how the bucket teeth end angle is adjusted by a process illustrated in FIG. 8.

FIG. 9 illustrates how the external processing device 30E adjusts the bucket teeth end angle $\alpha$ to a predetermined angle $\alpha_P$. A bucket $\mathbf{6}_t$ in FIG. 9 designates the position of the bucket 6 at the current time. Buckets $\mathbf{6}_{t1}$ to $\mathbf{6}_{t3}$ designate the positions of the bucket 6 at times t1 to t3, respectively, while the bucket teeth end angle $\alpha$ is adjusted. Buckets $\mathbf{6'}_{t1}$ to $\mathbf{6'}_{t3}$ designate the positions of the bucket 6 at the times t1 to t3 in the case where the bucket teeth end angle $\alpha$ is not adjusted. In this example, the operator attempts to cause the teeth end of the bucket 6 to contact the ground only with an arm closing operation.

In the case where the bucket teeth end angle $\alpha$ is not adjusted, the external processing device 30E predicts that the teeth end of the bucket 6 will contact the ground at a contact point CP at the time t3 and that the bucket teeth end angle $\alpha$ will become $\alpha_N$ at that time.

Then, in the case where the bucket teeth end angle $\alpha$ is adjusted, the external processing device 30E operates the excavation attachment so that the teeth end of the bucket 6 contacts the ground at the contact point CP, and the bucket teeth end angle $\alpha$ becomes the predetermined angle $\alpha_P$ at that time. In this example, the external processing device 30E automatically raises the boom 4 and automatically opens the bucket 6 while an arm closing operation is being performed, to cause the teeth end of the bucket 6 to contact the ground at the contact point CP.

The external processing device 30E may only automatically open the bucket 6 so that the bucket teeth end angle $\alpha$ becomes the predetermined angle $\alpha_P$ when the teeth end of the bucket 6 contacts the ground. In this case, the teeth end of the bucket 6 may be brought into contact with the ground at a point different from the contact point CP.

This configuration enables the external processing device 30E to cause the teeth end of the bucket 6 to contact the ground at the predetermined angle $\alpha_P$ in the case where the excavation target (the ground) is hard. Therefore, the hard ground can be broken efficiently.

Note that in the case where the hardness K of the excavation target is less than a predetermined hardness TH3 ($\leq$TH2), namely, in the case where the excavation target is soft, the external processing device 30E may adjust the bucket teeth end angle $\alpha$ to a predetermined angle $\alpha_Q$ (e.g., a blunt angle greater than the predetermined angle $\alpha_P$). This is to increase the amount of earth and sand taken into the bucket in a single excavation operation. In this case, the external processing device 30E may adjust the bucket teeth end angle $\alpha$ to a sharp angle less than the predetermined angle $\alpha_P$ as necessary. This is because the excavation load will not become excessively heavy even when the bucket teeth end angle $\alpha$ is adjusted to an angle other than 90 degrees because the excavation target is soft.

Next, with reference to FIGS. 10A to 10C, other examples of excavation support operations performed when the hardness K of the excavation target is determined harder than a predetermined hardness will be described.

Figure 10A:
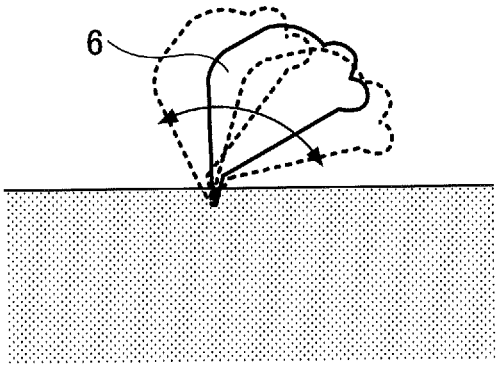
FIG. 10A illustrates another example of an excavation support operation performed when the excavation target is hard.

As illustrated in FIG. 10A, the external processing device 30E may swing the bucket 6 back and forth with the teeth end of the bucket 6 at the center of the swing when the teeth end of the bucket 6 comes into contact with the ground. This is to be capable of breaking the hard ground efficiently. For example, the external processing device 30E may swing the teeth end of the bucket 6 by repeating at least one of small vertical movements of the boom 4; small opening and closing of the arm 5; and small opening and closing of the bucket 6, when the hardness K of the excavation target is determined to be harder than the predetermined hardness in the initial excavation stage.

Figure 10B:
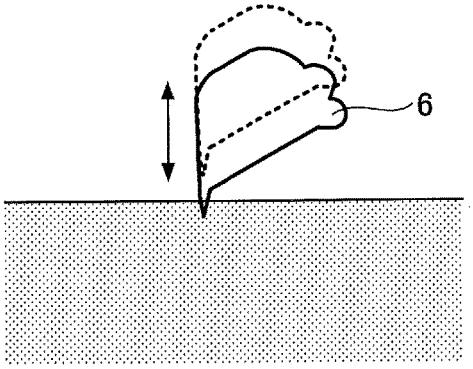
FIG. 10B illustrates yet another example of an excavation support operation performed when the excavation target is hard.

Alternatively, as illustrated in FIG. 10B, the external processing device 30E may shake the teeth end of the bucket 6 up and down when the teeth end of the bucket 6 comes into contact with the ground. Specifically, the external processing device 30E may extend and contract at least two of the boom cylinder 7, the arm cylinder 8, and the bucket cylinder 9 simultaneously, to shake the bucket 6 up and down.

Figure 10C:
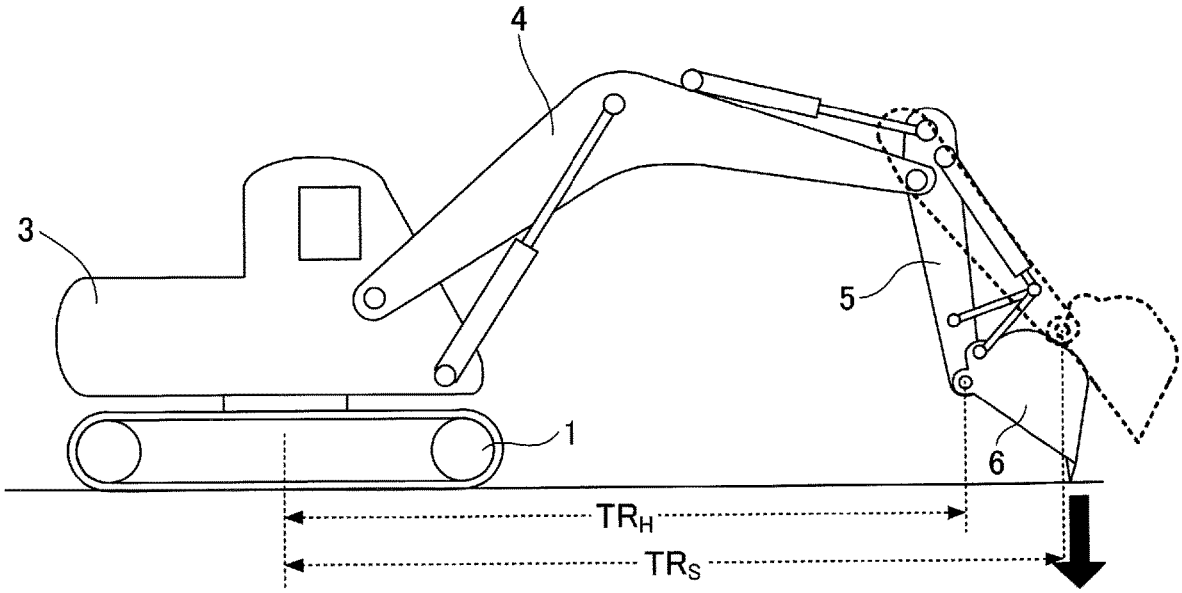
FIG. 10C illustrates yet another example of an excavation support operation performed when the excavation target is hard.

Alternatively, as illustrated in FIG. 10C, the external processing device 30E may adjust the attitude of the excavation attachment so that the excavation force acts vertically on the target excavation ground when having the teeth end of the bucket 6 contact the ground. For example, by using an attitude of the excavation attachment that brings an attachment length $TR_H$ shorter than an unadjusted attachment length $TR_S$, the external processing device 30E may cause the excavation force to act on the target excavation ground as vertically as possible. This is to be capable of adding an excavating force caused by the own weight of the shovel to the excavating force caused by the excavating attachment.

By using at least one of the methods described above, the external processing device 30E can break a hard ground efficiently. The external processing device 30E may determine which one of the methods described above is adopted in accordance with the hardness K of an excavation target. For example, the method in FIG. 10A may be adopted if the hardness K is greater than a predetermined hardness TH4; the method in FIG. 10B may be adopted if the hardness K is greater than a predetermined hardness TH5 (>TH4); and the method in FIG. 10C may be adopted if the hardness K is greater than a predetermined hardness TH6 (>TH5).

Figure 11:
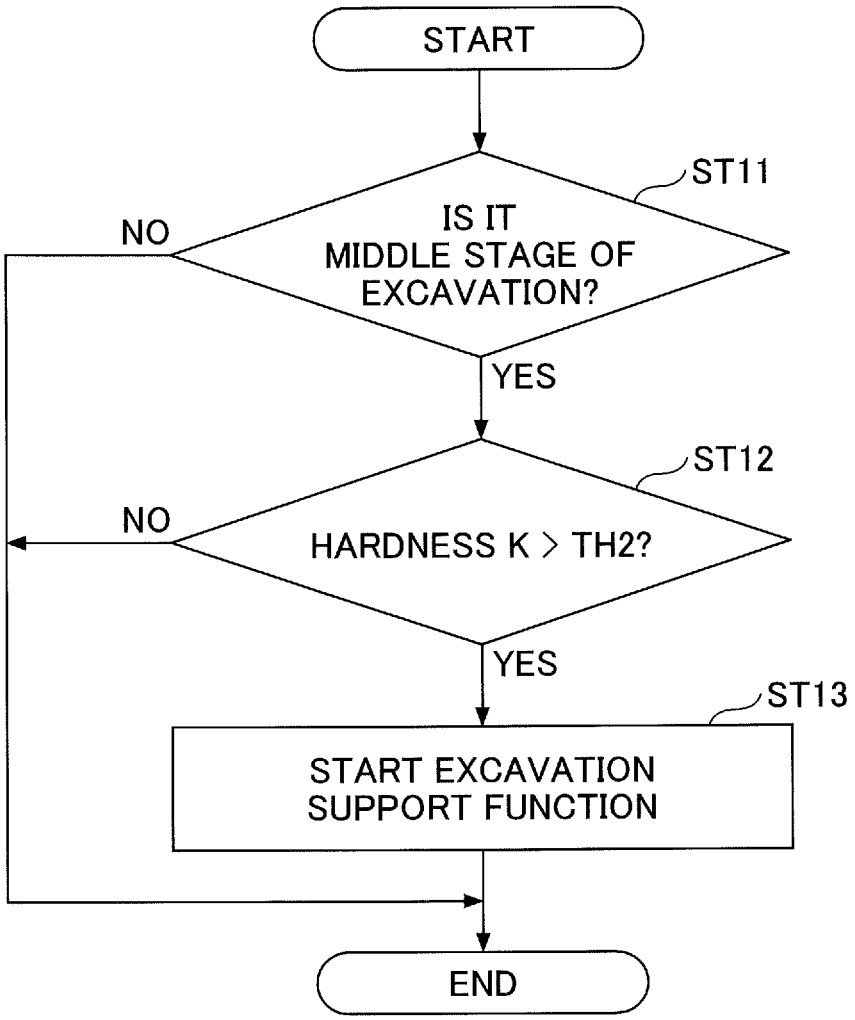
FIG. 11 is a flow chart illustrating yet another example of an excavation support operation.

Next, with reference to FIG. 11, yet another example of an excavation support operation will be described. FIG. 11 is a flow chart illustrating yet another example of an excavation support operation. The external processing device 30E repeatedly performs this excavation support operation at predetermined control cycles while the shovel is in operation.

First, at Step ST11, the external processing device 30E determines whether or not it is in a middle excavation stage. The middle excavation stage means a stage of pulling the bucket 6 toward the body of the shovel. In the present embodiment, the excavation reaction force deriving unit 34 of the external processing device 30E determines that the current excavation stage is the middle excavation stage, for example, if having determined that an arm closing operation is being performed during excavation. Alternatively, the external processing device 30E may determine that the current excavation stage is the middle excavation stage if having determined that no downward boom operation is performed and an arm closing operation is being performed during excavation.

If having determined that it is in the middle excavation stage (YES at Step ST11), at Step ST12, the external processing device 30E determines whether the hardness K of the excavation target is greater than the predetermined hardness TH2. In the present embodiment, the external processing device 30E reads the hardness K stored in the non-volatile memory during trial excavation, to compare the hardness K with the predetermined hardness TH2. However, the hardness K may be calculated at the initial excavation stage of each excavation operation.

If having determined that the hardness K of the excavation target is greater than the predetermined hardness TH2 (YES at Step ST12), at Step ST13, the external processing device 30E starts the excavation support operation function (Step ST13).

If having determined that it is not in the middle excavation stage (NO at Step ST11) or if having determined that the hardness K of the excavation target is less than or equal to the predetermined hardness TH2 (NO at Step ST12), the external processing device 30E terminates the excavation support operation this time without starting the excavation support operation function.

The excavation support operation function is a function of, for example, operating the excavation attachment fully automatically or semi-automatically to support the excavation operation. In this case, the external processing device 30E automatically opens and closes the bucket 6 so that the excavation depth becomes a target excavation depth D, for example, while an arm closing operation is performed in the middle excavation stage. The boom 4 may be moved up and down automatically. Specifically, the external processing device 30E may automatically close the bucket 6 so as not to exceed the target excavation depth D if the excavation depth is likely to exceed the target excavation depth D. Alternatively, the external processing device 30E may automatically open the bucket 6 to reach the target excavation depth D if the excavation depth is unlikely to reach the target excavation depth D. The same applies to the upward and downward movement of the boom 4. Also, the closing speed of the arm 5 may be adjusted.

The target excavation depth D is determined in accordance with, for example, the hardness K of the excavation target. Typically, the target excavation depth D is determined to be shallower when the excavation target is harder. This is to prevent the excavation reaction force from becoming excessively great due to deep excavation performed even though the excavation target is hard.

In the example in FIG. 11, the external processing device 30E starts the excavation support operation function only if having determined that the hardness K of the excavation target is greater than the predetermined hardness TH2; however, the external processing device 30E may start the excavation support operation function regardless of the hardness K of the excavation target. In this case, for example, the external processing device 30E sets the target excavation depth in the case of having determined that the hardness K of the excavation target is greater than the predetermined hardness TH2, to be smaller than the target excavation depth in the case of having determined that the hardness K of the excavation target is less than or equal to the predetermined hardness TH2.

In this way, the external processing device 30E derives the hardness K of an excavation target, to determine whether or not to support the excavation operation based on the hardness K. Alternatively, in accordance with the hardness K, the external processing device 30E determines the content of support for the excavation operation. Therefore, it is possible to excavate a hard target excavation ground more efficiently.

Figure 12A:
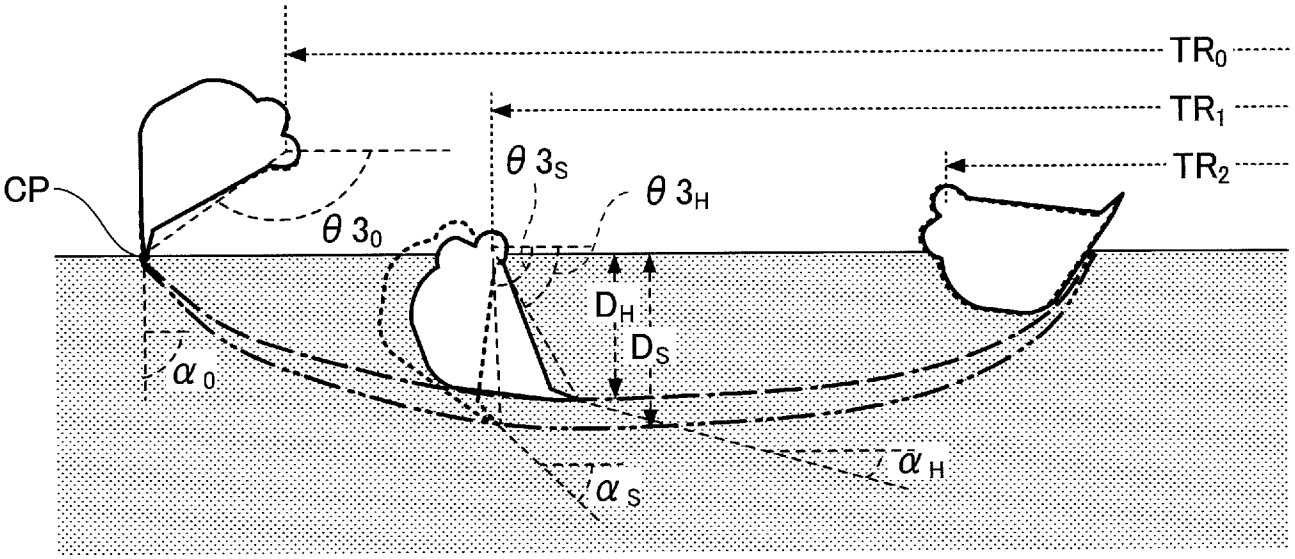
FIG. 12A illustrates how the bucket teeth end angle is adjusted by a process in FIG. 11.
Figure 12B:
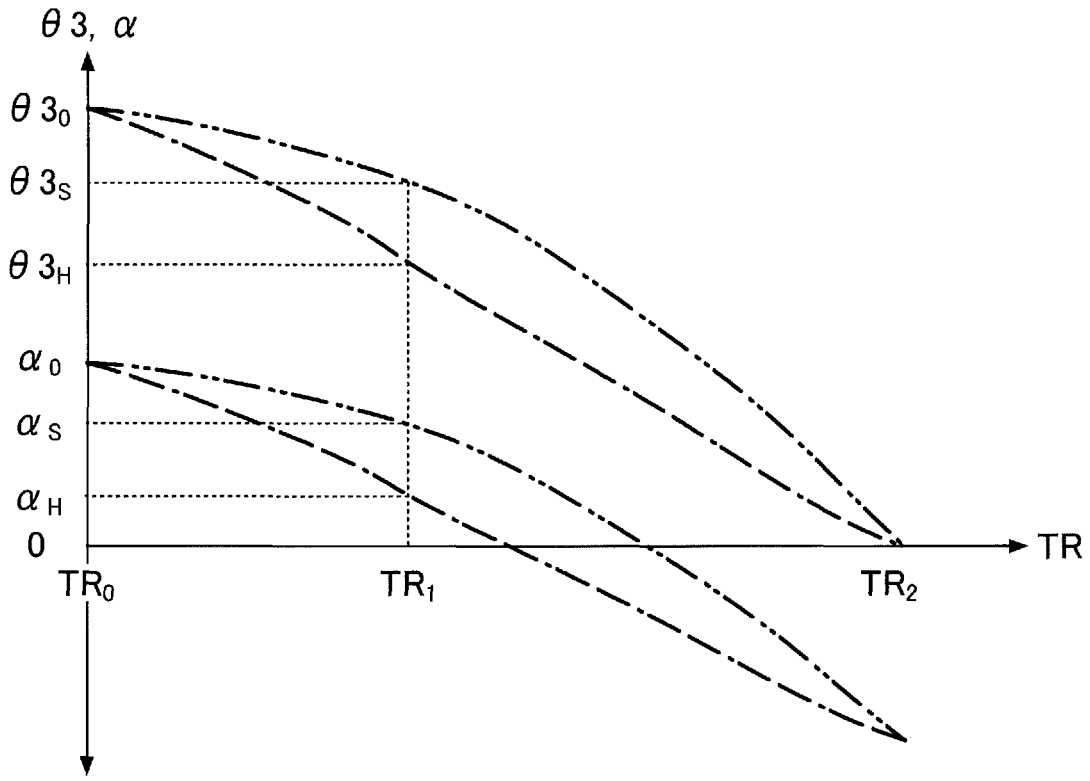
FIG. 12B is a graph illustrating a relationship between an attachment length TR, a bucket angle θ3, and the bucket teeth end angle α of the bucket.

Next, with reference to FIGS. 12A and 12B, how the bucket teeth end angle $\alpha$ is adjusted by the excavation support operation in FIG. 11 will be described. FIG. 12A illustrates how the external processing device 30E adjusts the excavation depth to a target excavation depth $D_H$ or a target excavation depth $D_S$. The target excavation depth $D_H$ is a target value in the case where the hardness K of the excavation target has been determined to be greater than the predetermined hardness TH2 (case of a hard ground); and the target excavation depth $D_S$ is a target value in the case where the hardness K of the excavation target has been determined to be less than or equal to the predetermined hardness TH2 (case of a soft ground).

FIG. 12A is diagram illustrating a relationship between the bucket 6 and the target excavation ground where a single-dashed line designates a trajectory of the teeth end of the bucket 6 excavating a hard ground, and a double-dashed line designates a trajectory of the teeth end of the bucket 6 excavating a soft ground. FIG. 12B is a graph illustrating a relationship between the attachment length TR, the bucket angle $\theta 3$, and the bucket teeth end angle $\alpha$ of the bucket where single-dashed lines designate transitions when a hard ground is excavated, and double-dashed lines designate transitions when a soft ground is excavated.

In this example, in either case of excavating a hard ground or a soft ground, the bucket 6 comes into contact with the ground with the teeth end at the contact point CP when the attachment length TR takes a value $TR_0$. In this case, the bucket angle $\theta 3$ takes a value $\theta 3_0$ and the bucket teeth end angle $\alpha$ takes a value $\alpha_0$.

The external processing device 30E determines that the current excavation stage is the middle excavation stage if having determined that an arm closing operation is being performed. Then, if having determined that the hardness K of the excavation target is greater than the predetermined hardness TH2, the external processing device 30E closes the bucket 6 automatically so that the excavation depth becomes the target excavation depth $D_R$. Specifically, as illustrated in FIG. 12A, the bucket 6 is closed in accordance with the closing state of the arm 5 so that the teeth end of the bucket 6 moves along the trajectory designated by the single-dashed line. As a result, when the attachment length TR takes a value $TR_1$, the bucket angle θ3 takes a value $\theta 3_H$ and the bucket teeth end angle α takes a value $\alpha_H$.

On the other hand, if having determined that the hardness K of the excavation target is less than or equal to the predetermined hardness TH2, the external processing device 30E automatically closes the bucket 6 so that the excavation depth becomes the target excavation depth $D_S$. Specifically, as illustrated in FIG. 12A, the bucket 6 is closed in accordance with the closing state of the arm 5 so that the teeth end of the bucket 6 moves along the trajectory designated by the double-dashed line. As a result, when the attachment length TR takes the value $TR_1$, the bucket angle θ3 takes a value $\theta 3_5$ ($>\theta 3_H$) and the bucket teeth end angle α takes a value $\alpha_S$ ($>\alpha_H$).

In this example, when the attachment length TR takes a value $TR_2$ when completing the middle excavation stage, the bucket 6 is in the same position in either case of excavating a hard ground or a soft ground.

In the way, the external processing device 30E automatically closes the bucket 6 while an arm closing operation is being performed so that the excavation depth becomes the target excavation depth in accordance with the hardness K of the excavation target. However, the external processing device 30E may automatically raise the boom 4 to achieve the target excavation depth.

This configuration enables the external processing device 30E to make the excavation depth shallower in the case where the excavation target is hard, than the excavation depth in the case where the excavation target is soft. Therefore, in the case where the excavation target is hard, the excavation operation is performed, for example, as if to peel off the ground, and it is possible to avoid performing wasteful excavation operations, in which the bucket would become immobile due to an excessive increase in the excavation reaction force when excavating the hard ground. As a result, the hard ground can be excavated efficiently. Also, it is possible to make the depth of the excavation deeper in the case where the excavation target is softer, than in the case where the excavation target is harder. Therefore, it is possible to increase the amount of excavation by a single excavation operation. As a result, the soft ground can be excavated efficiently.

As described above, the external processing device 30E drives the attachment to control the angle of the teeth end of the bucket 6 with respect to the target excavation ground, in accordance with the hardness K of the target excavation ground. Specifically, the external processing device 30E automatically adjusts the angle of the teeth end of the bucket 6 with respect to the target excavation ground (bucket teeth end angle α) when the teeth end of the bucket 6 contacts the target excavation ground in accordance with the hardness K of the target excavation ground. Therefore, the shovel having the external processing device 30E installed can efficiently break and efficiently excavate a hard ground. Also, for a soft ground, by increasing the amount of excavation by a single excavation operation as much as possible, it is possible to efficiently excavate the soft ground.

The external processing device 30E may control the bucket angle θ3 in accordance with the hardness K of the target excavation ground in the middle excavation stage. Specifically, the external processing device 30E may automatically adjust the bucket angle θ3 in accordance with the hardness K of the target excavation ground in the middle excavation stage. This configuration enables the shovel having the external processing device 30E installed to achieve an excavation depth suitable for the hardness K of the target excavation ground.

The external processing device 30E may determine the position (contact point CP) at which the teeth end of the bucket 6 contacts the target excavation ground. Specifically, when adjusting the bucket teeth end angle α before the teeth end of the bucket 6 contacts the target excavation ground, the external processing device 30E predicts the position of the contact point CP in the case of not performing the adjustment, and sets the predicted contact point CP as the target contact point. Then, when the adjustment of the bucket teeth end angle α is performed, the external processing device 30E moves at least one of the boom 4, the arm 5, and the bucket 6 automatically or semi-automatically so that the teeth end of the bucket 6 contacts the target excavation ground at the contact point CP. This configuration enables the external processing device 30E to cause the teeth end of the bucket 6 to contact the ground at the position where the operator attempts to make the contact, even in case of performing the adjustment of the bucket teeth end angle α.

The external processing device 30E may optionally decrease the length of the attachment when the hardness K of the target excavation ground is greater than or equal to a predetermined hardness, to be shorter than the length of the attachment when the hardness K of the target excavation ground is less than the predetermined hardness. Specifically, the external processing device 30E may adjust the attachment length TR when the teeth end of the bucket 6 contacts the target excavation ground, for example, as illustrated in FIG. 10C. For example, an attachment length $TR_H$ when the hardness K of the target excavation ground is greater than or equal to the predetermined hardness TH2 may be smaller than an attachment length $TR_S$ when the hardness K of the target excavation ground is less than the predetermined hardness TH2. This is to be capable of adding an excavating force caused by the own weight of the shovel to the excavating force caused by the excavating attachment. This configuration enables the shovel having the external processing device 30E installed to break a hard ground more efficiently.

The external processing device 30E may swing the bucket 6 back and forth when the teeth end of the bucket 6 contacts the target excavation ground, for example, in the case where the hardness K of the target excavation ground is greater than or equal to the predetermined hardness TH2 as illustrated in FIG. 10A. Alternatively, the external processing device 30E may shake the bucket 6 up and down when the teeth end of the bucket 6 contacts the target excavation ground, for example, in the case where the hardness K of the target excavation ground is greater than or equal to the predetermined hardness TH2 as illustrated in FIG. 10B. This is to break the hard ground more efficiently.

In the middle excavation stage, the external processing device 30E may control the bucket angle 83 when the hardness K of the target excavation ground is greater than or equal to the predetermined hardness TH2, to be less than the bucket angle 83 when the hardness K of the target excavation ground is less than the predetermined hardness TH2. In the middle excavation stage, alternatively, the external processing device 30E may increase the bucket angle 83 when the hardness K of the target excavation ground is less than the predetermined hardness TH2, to be greater than the bucket angle θ3 when the hardness K of the target excavation ground is greater than or equal to the predetermined hardness TH2. The same applies to the bucket teeth end angle α. This is to be capable of performing excavation with an excavation depth suitable for the hardness K of the target excavation ground. This configuration enables the shovel having the external processing device 30E installed to excavate a hard ground more efficiently.

As above, preferred embodiments have been described in the present disclosure. However, the present inventive concept is not limited to the embodiments above described. Various modifications, substitutions, and the like may be applied to the embodiments described above without deviating from the scope in the claims. Also, the features described with reference to the embodiments described above may be suitably combined unless no technical inconsistency is introduced.

For example, in the embodiments described above, the external processing device 30E is described as a control device external to and separated from the controller 30; however, the external processing device 30E may be integrally integrated with the controller 30. Also, instead of the controller 30, the external processing device 30E may directly control the operation control unit E1.

What is claimed is:

1. A shovel comprising:

a traveling lower body;

a revolving upper body mounted on the traveling lower body;

an attachment attached to the revolving upper body; and a control device mounted on the revolving upper body and configured to drive the attachment, wherein the control device controls an angle of a teeth end of a bucket with respect to a target excavation ground, in accordance with information on hardness of the target excavation ground.

2. The shovel as claimed in claim 1, wherein the control device controls a bucket angle in accordance with the hardness of the target excavation ground in a middle excavation stage.

3. The shovel as claimed in claim 1, wherein the control device determines a position at which the teeth end of the bucket contacts the target excavation ground.

4. The shovel as claimed in claim 1, wherein the control device controls a length of the attachment in a case of the hardness of the target excavation ground being greater than or equal to a predetermined hardness, to be shorter than a length of the attachment in a case of the hardness of the target excavation ground being less than the predetermined hardness.

5. The shovel as claimed in claim 1, wherein the control device shakes the bucket up and down or swings the bucket back and forth when the teeth end of the bucket comes into contact with the target excavation ground, in a case of the hardness of the target excavation ground being greater than or equal to a predetermined hardness.

6. The shovel as claimed in claim 1, wherein in a middle excavation stage, the control device controls a bucket angle in a case of the hardness of the target excavation ground being greater than or equal to a predetermined hardness, to be less than a bucket angle in a case of the hardness of the target excavation ground being less than the predetermined hardness.

7. The shovel as claimed in claim 1, wherein in a middle excavation stage, the control device controls a bucket angle in a case of the hardness of the target excavation ground being less than a predetermined hardness, to be greater than a bucket angle in a case of the hardness of the target excavation ground being greater than or equal to the predetermined hardness.

8. The shovel as claimed in claim 1, wherein the control device adjusts the angle of the teeth end of the bucket with respect to the target excavation ground when the teeth end of the bucket contacts the target excavation ground, in accordance with the hardness of the target excavation ground.

9. The shovel as claimed in claim 1, wherein the control device controls an insertion depth of the bucket, in accordance with the hardness of the target excavation ground.

10. The shovel as claimed in claim 1, wherein the control device causes an image display device to display information on the hardness of the target excavation ground.

11. The shovel as claimed in claim 1, wherein the control device stores information on the hardness of the target excavation ground in a landform database.

12. The shovel as claimed in claim 1, wherein the control device transmits information on the hardness of the target excavation ground to an external device.

13. A shovel comprising:

a traveling lower body;

a revolving upper body mounted on the traveling lower body;

an attachment including a bucket attached to the revolving upper body; and a control device mounted on the revolving upper body and configured to drive the attachment, wherein the control device adjusts an angle of a teeth end of the bucket with respect to a target excavation ground when the teeth end of the bucket contacts the target excavation ground, in accordance with information on hardness of a surface of the target excavation ground.

14. A shovel comprising:

a traveling lower body;

a revolving upper body mounted on the traveling lower body;

an attachment including a bucket attached to the revolving upper body; and a control device mounted on the revolving upper body and configured to drive the attachment, wherein the control device adjusts a bucket angle of the bucket in a middle excavation stage, in accordance with information on hardness of a target excavation ground.

15. A shovel comprising:

a traveling lower body;

a revolving upper body mounted on the traveling lower body;

an attachment including an arm and a bucket attached to the revolving upper body; and a control device mounted on the revolving upper body and configured to drive the attachment, wherein the control device adjusts a bucket angle of the bucket in accordance with a closing state of the arm, in accordance with information on hardness of a target excavation ground.

* * * * *